United States Patent [19]

Numata

[11] 4,442,381

[45] Apr. 10, 1984

[54] AUTO STROBE CONTROL CIRCUIT

[75] Inventor: Saburo Numata, Urawa, Japan

[73] Assignee: Fuji Photo Optical Co., Ltd., Japan

[21] Appl. No.: 413,090

[22] Filed: Aug. 30, 1982

[51] Int. Cl.[3] ..... H05B 41/32

[52] U.S. Cl. ..... 315/151; 250/214 L; 354/416; 354/428; 356/223

[58] Field of Search ..... 315/151, 159, 241 P; 356/223; 250/214 P, 214 L; 354/24, 33, 139, 145

[56] References Cited

U.S. PATENT DOCUMENTS 3,879,740 4/1975 Mori et al. ..... 354/24

4,100,407 7/1978 Takahashi ..... 240/214 P

*Primary Examiner*—Eugene R. LaRoche

*Attorney, Agent, or Firm*—Saidman, Sterne & Kessler

[57] ABSTRACT

An auto strobe control circuit comprising a flash stopping signal generating circuit for measuring the luminance of an object exposed to light emitted from a flash tube by a photometric circuit, sending the obtained photometric value, film sensitivity information and aperture information to an operational amplifier to subject them to an arithmetic operation, and generating a flash stopping signal when the value calculated by the arithmetic operation, reaches a predetermined light amount. The photometric circuit essentially consists of a photoelectromotive force type light receiving element and a log-conversion diode connected in series with a constant-voltage circuit, and a temperature compensation circuit connected with the log-conversion diode. The photometric value is sent from a connection point between the light receiving element and the log-conversion diode to the operational amplifier. A voltage follower is positioned between the temperature compensation circuit and the log-conversion diode.

7 Claims, 1 Drawing Figure

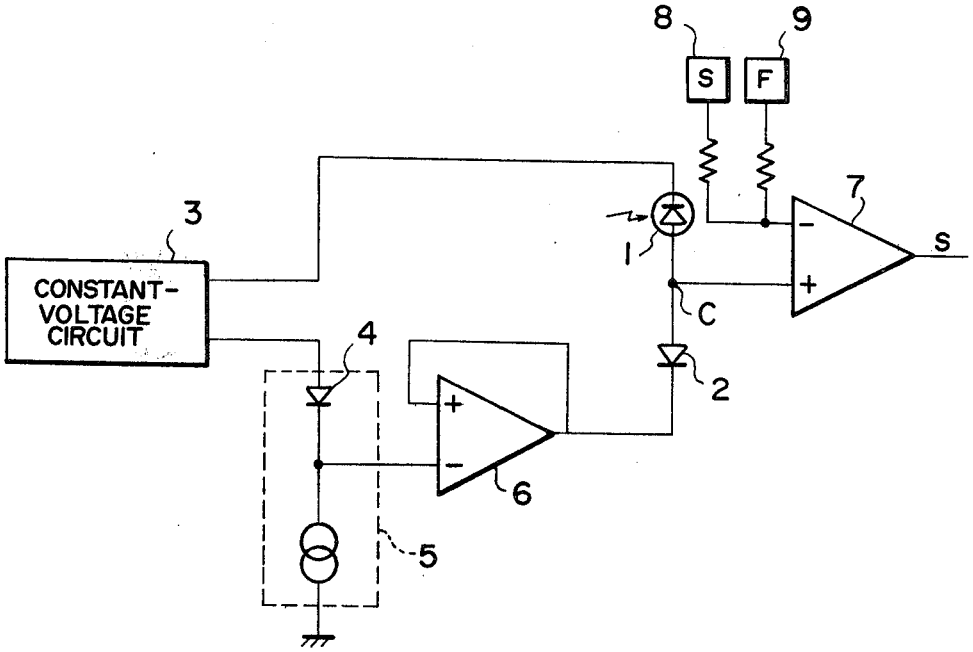
8
9
S
F
7
3
CONSTANT-
VOLTAGE
CIRCUIT
1
S
C
4
2
6
5

AUTO STROBE CONTROL CIRCUIT

BACKGROUND OF THE INVENTION

1. Field of the Invention

This invention relates to an auto strobe control circuit in which the luminance of an object exposed to light emitted from a flash tube is log-converted and subjected to an arithmetic operation.

2. Description of the Prior Art

Auto strobes used for photographic purposes measure the luminance of an object exposed to light emitted from a flash tube and stops flashing of the tube when the amount of light reflected from the object reaches a predetermined value, thereby controlling the flashing duration to obtain a predetermined amount of light on the image surface.

In many conventional auto strobes, the light reflected from an object is converted to a photoelectric current, which is then directly integrated by a capacitor. Therefore, the conventional auto strobes are disadvantageous in that the measuring range is limited to the order of $10^2$ and there is a limitation on the usable ranges of aperture and film sensitivity.

Under these circumstances, it has been proposed in Japanese Unexamined Patent Publication No. 54(1979)-73029 to log-convert and arithmetically process the luminance of the object, thereby to widen the measuring range from the order of $10^2$ to $10^6$.

The auto strobe control circuit disclosed in Japanese Unexamined Patent Publication No. 54(1979)-73029 is very convenient for practical purposes because wider ranges of apertures and film sensitivities can be used by widening the measuring range by means of log-conversion. In this auto strobe control circuit, a log-compression circuit comprising a log diode connected to a feedback circuit coupling the negative input terminal of an operational amplifier with the output terminal thereof is used as a means for log-conversion. However, the log-compression circuit is not suitable for use in a strobe photometric circuit because the response time is too long (for example, several tens of microseconds) due to the operation time in the operational amplifier. Accordingly, the auto strobe control device disclosed in Japanese Unexamined Patent Publication No. 54(1979)-73029 involves a risk of malfunctioning due to the low response characteristics attributable to the opetation circuit in the log-compression circuit.

SUMMARY OF THE INVENTION

The primary object of the present invention is to provide an improved auto strobe control circuit in which the luminance of an object exposed to a flash is log-converted and subjected to an arithmetic operation.

Another object of the present invention is to provide an auto strobe control circuit which exhibits quick photometric response and can quickly control strobe flashing at a high accuracy.

The specific object of the present invention is to provide an auto strobe control circuit provided with a photometric circuit containing a log-compression circuit exhibiting excellent response characteristics.

The above objects are accomplished by an auto strobe control circuit comprising a flash stopping signal generating circuit for measuring the luminance of an object exposed to light emitted from a flash tube by a photometric circuit containing a photoelectromotive force type light receiving element, sending the obtained photometric value and information on film sensitivity and aperture value to an operational amplifier to subject said values to an arithmetic operation, and generating a flash stopping signal when the value calculated by the arithmetic operation reaches a predetermined light amount, said photometric circuit essentially consisting of said light receiving element and a log-conversion diode connected in series with a constant-voltage circuit, and a temperature compensation circuit connected with said log-conversion deode, said photometric value being sent out from a connection point between said light receiving element and said log-conversion diode.

In the auto strobe control circuit in accordance with the present invention, instead of using an operational amplifier in a log-compression circuit, the photometric value is sent to the operational amplifier as a voltage drop developing at the connection point between the light receiving element and the log-conversion diode in the photometric circuit described above. Accordingly, the response time in the auto strobe control circuit is very short. Experiments conducted by the inventors revealed that the response time of the photometric circuit employed in the auto strobe control circuit in accordance with the presint invention is about 3 μsec., which is about one-tenth of the response time in the conventional auto strobe control circuit. Because of its quick photometric response, the auto strobe control circuit in accordance with the present invention can quickly control the stopping of the strobe flashing with high accuracy.

BRIEF DESCRIPTION OF THE DRAWING

The sole FIGURE is a circuit diagram showing the major part of the auto strobe control circuit in accordance with the present invention.

DESCRIPTION OF THE PREFERRED EMBODIMENT

The present invention will hereinbelow be described in further detail with reference to the accompanying drawing.

Referring to the FIGURE, which shows the major part of the auto strobe control circuit in accordance with the present invention, a photoelectromotive force type light receiving element 1, which may be a silicon blue cell, measures the luminance of an object exposed to light emitted from a flash tube (not shown). The light receiving element 1 is connected in series with a log-conversion diode 2 at a connection point C. The log-conversion diode 2 is connected with a diode 4 which is biased by a predetermined current fed from a constant-voltage circuit 3. Accordingly, a forward voltage is fed from the diode 4 to one end of the log-conversion diode 2. The diode 4 constitutes part of a temperature compensation circuit 5 for compensating the temperature change component of the output fed from the log-conversion diode 2. Between the temperature compensation circuit 5 and the log-conversion diode 2 is positioned a voltage follower 6, which equalizes the output voltage with the input voltage. The light receiving element 1 is preferably biased by a predetermined voltage fed from the constant-voltage circuit 3.

The output of the photometric circuit having the configuration described above is sent to an operational amplifier 7 for controlling the strobe. The positive input terminal of the operational amplifier 7 is connected with the connection point C between the light receiving element 1 and the log-conversion diode 2. The negative input terminal of the operational amplifier 7 is connected with a film sensitivity setting circuit 8 and an aperture setting circuit 9.

The auto strobe control circuit having the abovedescribed configuration works as described below.

When the flash lamp is activated to emit light and an object is exposed thereto, the light reflected from the object is received by the light receiving element 1. The light receiving element 1 generates a photoelectric current proportional to the luminance of the object, i.e. the intensity of the light reflected from the object. The generated photoelectric current flows to the log-conversion diode 2 and, as a result, a voltage drop occurs at the connection point C. It is known that the voltage at the connection point C changes, in general, between 100 mV and 700 mV. Therefore, to effectively measure the voltage drop, it is preferable that the light receiving element 1 be biased at a voltage in the range between 200 mV and 500 mV by the constant-voltage circuit 3.

When the voltage at the connection point C is sent to the operational amplifier 7, the operational amplifier 7 carries out an arithmetic operation on the voltage sent from the connection point C, the film sensitivity information fed from the film sensitivity setting circuit 8 and the aperture information fed from the aperture setting circuit 9. Based on the value calculated by this arithmetic operation, the operational amplifier 7 generates a flash stopping signal S to turn the flash tube off.

I claim:

1. An auto strobe control circuit comprising a flash stopping signal generating circuit for measuring the luminance of an object exposed to light emitted from a flash tube by a photometric circuit containing a photoelectromotive force type light receiving element, sending the obtained photometric value and information on film sensitivity and aperture value to an operational amplifier to subject said value and said information to an arithmetic operation, and generating a flash stopping signal when the value calculated by the arithmetic operation reaches a predetermined light amount, said photometric circuit essentially consisting of said light receiving element and a log-conversion diode connected in series with a constant-voltage circuit, and a temperature compensation circuit connected with said log-conversion diode, said photometric value being sent out from a connection point between said light receiving element and said log-conversion diode.

2. An auto strobe control circuit as defined in claim 1 wherein said connection point is connected to the positive input terminal of said operational amplifier.

3. An auto strobe control circuit as defined in claim 1 wherein said information on film sensitivity and aperture value is fed to the negative input terminal of said operational amplifier.

4. An auto strobe control circuit as defined in claim 1 wherein said temperature compensation circuit contains a diode which is biased by a predetermined current fed from said constant-voltage circuit.

5. An auto strobe control circuit as defined in claim 1 wherein a voltage follower is positioned between said temperature compensation circuit and said log-conversion diode.

6. An auto strobe control circuit as defined in claim 1 wherein said light receiving element is biased by a predetermined voltage from said constant-voltage circuit.

7. An auto strobe control circuit as defined in claim 6 wherein said light receiving element is biased at a voltage in the range between 200 mV and 500 mV by said constant-voltage circuit.

* * * * *